United States Patent [19]

Harrison et al.

[11] 4,150,510

[45] Apr. 24, 1979

[54] SAFETY GATES

[75] Inventors: Frank B. Harrison, Berkhamsted; Colin J. Hornsby, Rickmansworth, both of England

[73] Assignee: Dexion-Comino International Limited, Middlesex, England

[21] Appl. No.: 930,451

[22] Filed: Aug. 2, 1978

[30] Foreign Application Priority Data

Aug. 12, 1977 [GB] United Kingdom ..... 33950/77

[51] Int. Cl.[2] ..... E05D 7/08

[52] U.S. Cl. ..... 49/388; 52/64

[58] Field of Search ..... 52/64, 74; 49/388, 381; 52/174

[56] References Cited

U.S. PATENT DOCUMENTS

| | | | |
|---|---|---|---|
| 659,117 | 10/1900 | White et al. | 52/64 X |
| 2,590,464 | 3/1952 | Raymond | 52/64 |

*Primary Examiner*—Kenneth Downey

*Attorney, Agent, or Firm*—Pollock, Vande Sande and Priddy

[57] ABSTRACT

A safety gate comprises a counterbalanced gate structure which consists of two side parts connected at one end by a fence part and which is pivotably mounted on a supporting structure by way of the said side parts to permit the gate structure to be swung between two end positions, and stop means pivotably mounted in relation to the supporting structure, preferably on the pivot for the gate structure, and automatically engageable with the supporting structure and by the side parts of the gate structure for determining the said end positions. Extensions telescopically adjustable longitudinally in relation to the side parts may be provided for adjustably counterbalancing the gate structure. The stop means advantageously comprises a stop plate pivotably mounted, between parts of the gate and supporting structures, on a pivot pin fixed in the said part of the latter.

7 Claims, 5 Drawing Figures

SAFETY GATES

This invention concerns improvements relating to safety gates of the kind, hereinafter referred to as the kind set forth, in which a gate can be swung about a horizontal axis between two end positions in one of which it provides or continues a permanent fence or boundary, for example of a raised storage area, and in the other of which it bounds a segregated area, for example a part of a storage area reserved as a loading and/or unloading platform for use in conjunction with a hoist, lift or the like. It is an object of the invention to provide a safety gate of this kind which is easy, safe and reliable to operate, although of simple, inexpensive construction.

According to the invention, a safety gate of the kind set forth comprises a counterbalanced gate structure which consists of two side parts connected at one end by a fence part and which is pivotably mounted on a supporting structure by way of the said side parts to permit the gate structure to be swung between the two end positions, and stop means pivotably mounted in relation to the supporting structure and automatically engageable with the supporting structure and by the side parts of the gate structure for determining the said end positions. Advantageously extensions telescopically adjustable longitudinally in relation to the said side parts are provided for adjustably counterbalancing the gate structure. Locking or detent means may be provided for securing the counterbalance adjustment.

Figure 1:
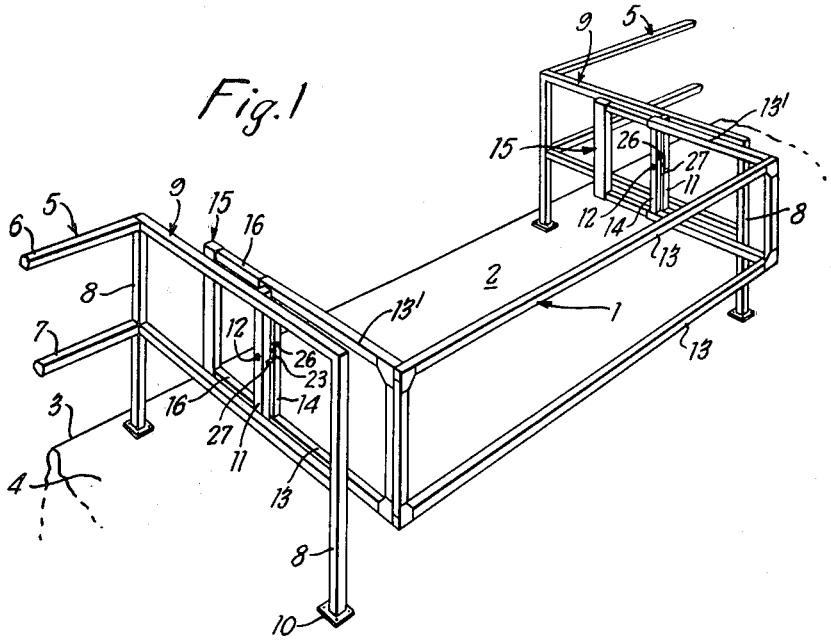
Figure 4:
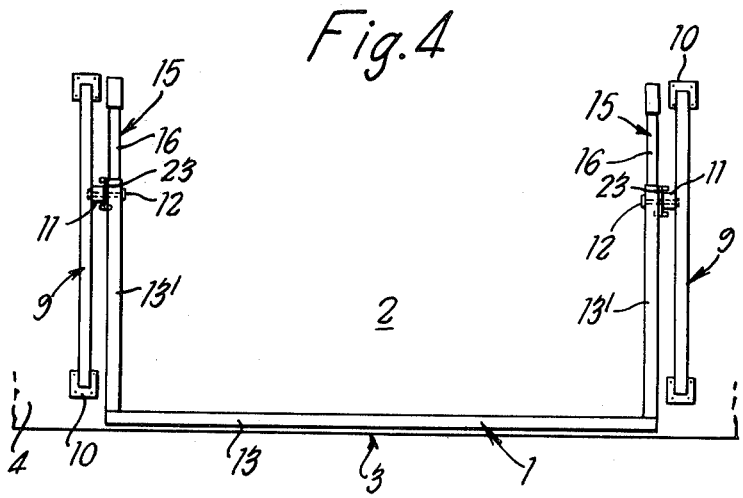
Figure 2:
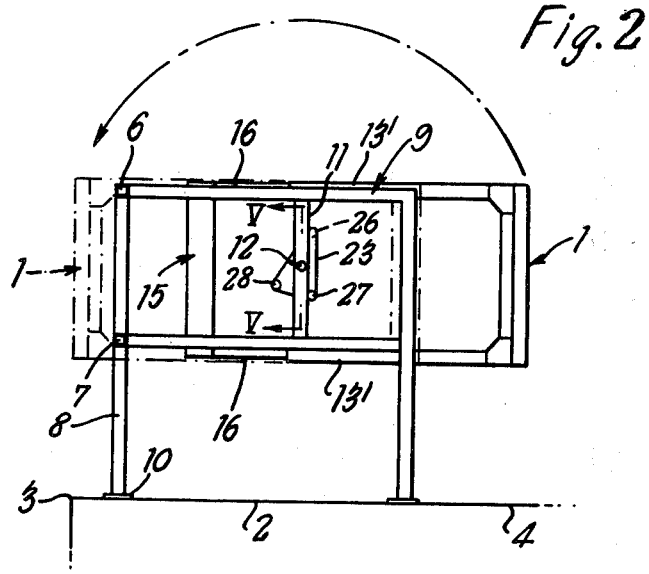
Figure 3:
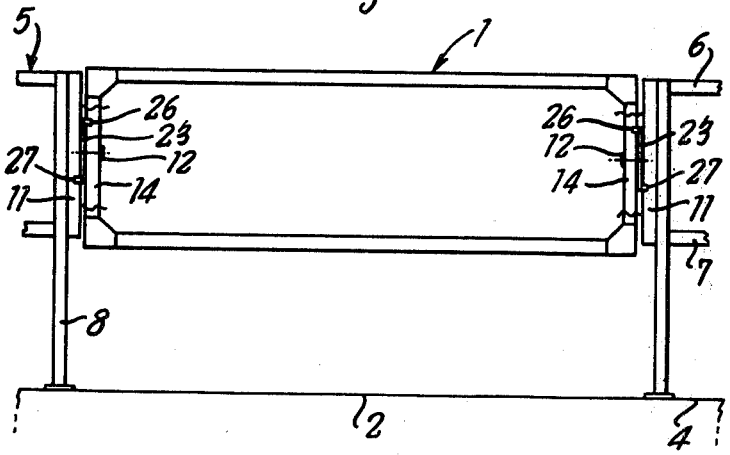
Figure 5:
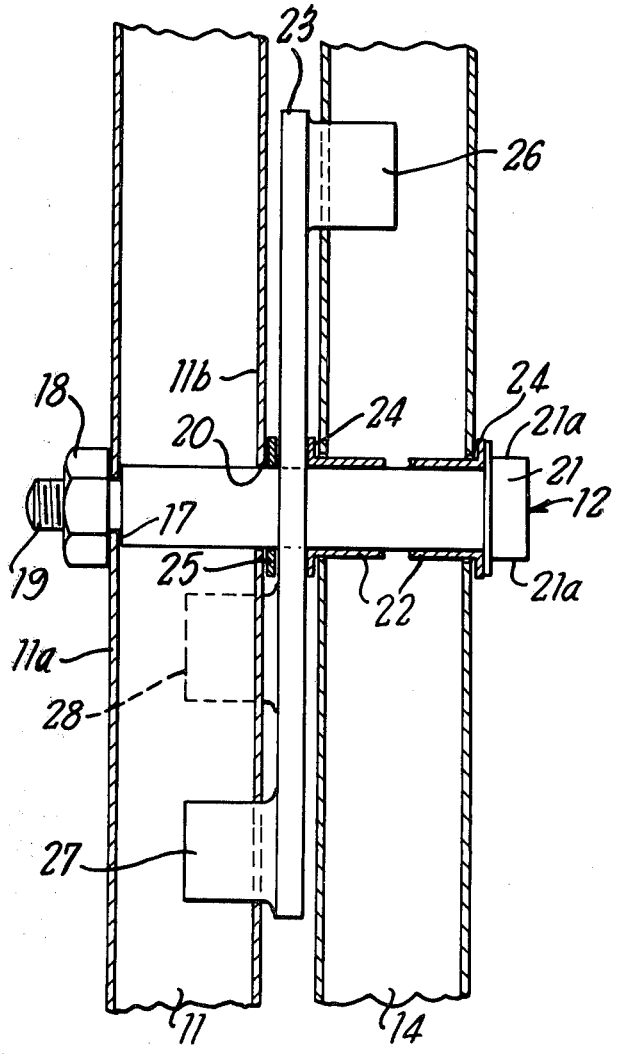

One embodiment of the invention will now be more fully described, by way of example, with reference to the accompanying drawings, in which:

FIG. 1 is a perspective view of a gate in the position to which it has been swung inwardly, from substantial alignment with a permanent fence, to bound a loading platform area, FIG. 2 is a side elevation showing the gate in the same end position in full lines and in the opposite, swung-out end position in chain lines, FIG. 3 is a front elevation of the gate, FIG. 4 is a plan view of the gate alone in the swung-out position and FIG. 5 is a detail section on the line V—V in FIG. 2, of stop means to a larger scale.

In the example illustrated, the area to be bounded by the gate 1 is a rectangular loading-platform area 2 at an edge 3 of an elevated storage-floor 4 which is bounded elsewhere by a safety-fence 5 consisting of hand and knee rails 6,7 with posts 8 at intervals. On each side of the loading area, there are fence sections 9 at right angles to the main fence 5, which is interrupted at this place. The sections 9, made from rectangular hollow section metal, e.g. of box section, like the main fence 5, have parts 8 anchored firmly to the floor 4 with the aid of base plates 10 or strips. At rather more than half the section length from the main fence 5, a short upright 11 extending between the hand and knee rails of each section 9 is fixed to the insides of the rails. Pivot pins 12 for the gate 1 are mounted in the uprights 11 at about their mid height.

The gate 1 itself comprises a main frame of rectangular form, open at one end, as seen in plan view (FIG. 4). Similarly to the fence 5, this gate frame is composed of rectangular hollow-section hand and knee rails 13 and short uprights 14. Short extension frames 15 of rectangular form, open at one end, as seen in side view have their shank 16 slidably engaged in the rails 13[1] of the sides of the gate frame. These extension frames 15 may be of square-section solid steel or caste or fabricated from other heavy material. They serve as counter-balance weights to the main frame of the gate 1, thereby facilitating movement therefore by the operator. Their weight is selected for this purpose, but the counter-balancing effect can be adjusted by sliding the extension frames 15 in and out. They may be locked or latched in the adjusted position in the gate frame by means of small bolts or detents (not shown) mounted in the side rails 13[1] of the gate frame and engageable in selected holes or recesses of series thereof in the shanks 16.

The main frame of the gate 1 is mounted by its uprights 14 on the pivot pins 12. It could, alternatively, be mounted on trunnions projecting from the uprights 11. It is swingable between the position shown in FIG. 1 and in full lines in FIG. 2, in which the transverse part, forming the gate 1 proper, extends between the inner ends of the side fence sections 9 and the position shown in chain lines in FIG. 2 in which the rails 13 of that part are substantially in alignment with the main-fence rails 6,7. The amount by which the frame extensions 15 project from the gate frame should not be such that their ends foul the floor 4 as that frame is swung through 180° from one said position to the other, possibly over goods deposited on the platform. Handles may be provided on the sides of the gate frame to facilitate easy handling of the counter-balanced gate 1.

As hereinafter described, self-positioning stops acting between the fixed uprights 11 and the uprights 14 of the gate determine the end positions of the gate.

A preferred arrangement of pivot 12 and stops in relation to the upright 11 of the fixed frame and the upright 14 of the swingable gate frame is shown in FIG. 5. The pivot pin 12 consists of a bolt with a shoulder 17 by which the pin can be secured axially in the upright 11 by tightening a nut 18 on the threaded end portion 19 of the bolt to clamp the outer wall **11*a* of that upright against the shoulder. The main cylindrical part of the pin passes through the inner wall 11*b* by a hole 20 of circular shape. At the end remote from the nut 18, the pin has a head 21 with flats 21*a* by which the pin can be held by a tool while the nut is tightened. A divided, flanged, sleeve 22 supported on the pin provides a bearing on which the swingable upright 14 is supported. A stop plate 23 is also free to turn on the bolt between one of the two flanges 24 of the sleeve 22 and a washer 25. The flanges 24 lie outside the upright 14**.

The stop plate 23 is of triangular shape (FIG. 2) and has stops 26,27,28, suitably studs welded to its faces in the said corners. The studs 27 and 28 extend towards the fixed upright 11 and the stud 26 towards the swingable upright 14, in each case sufficiently to overlap the respective upright (FIG. 5).

In the swing-in position of the gate 1 (FIG. 2), the upper part of the swingable upright 14 is in engagement with the associated plate 23 by way of the stop 26 and the said plate is in engagement with the fixed upright 11 by way of the stop 27, so that the gate is arrested in the swung-in position. On commencing to swing the gate 1 in the direction of the arrow in FIG. 2 each plate 23 can initially remain in the same position and will only be entrained by the gate upon encounter of what had been the lower part of the upright 14 with the stop 26. Resultant turning of the plate 23 will be arrested when the stop 28 encounters the fixed upright 11. By reason of the continued engagement of the originally lower part of the upright 14 with the stop 26, arrest of the plate 23 will result in arrest of the gate 1 also, which at this stage is in the swung-out position indicated in chain lines in FIG. 2.

On swinging of the gate 1 from the (chain line) swung-out position to the full-line swung-in position (reversely to the arrow in FIG. 2), the plate 23 is again not entrained until the said originally upper part of the upright 14 encounters the stop 26, movement of the plate and the gate being arrested only when the plate and gate reach the above-described position shown in full lines in FIG. 2. The stop means are thus fully self-positioning and the positive arrest of the gate 1 fully automatic. As may be seen from FIG. 2, the stop means does not extend outside the outlines of the uprights 11, 14 and at all times occupies a compact space remote from parts of the gate likely to be handled in swinging over the gate. There is little or no danger of harm to the operator or of damage to goods resting upon or being moved on the area 2.

We claim:

1. A safety gate of the kind set forth, comprising a supporting structure, a counterbalanced gate structure which consists of two side parts connected at one end by a fence part and which is pivotably mounted on the supporting structure by way of the said side parts to permit the gate structure to be swung between two end positions, and stop means pivotably mounted in relation to the supporting structure and automatically engageable with the supporting structure and by the side parts of the gate structure for determining the said end positions.

2. A gate according to claim 1, wherein extensions telescopically adjustable longitudinally in relation to the said side parts are provided for adjustably counterbalancing the gate structure.

3. A gate according to claim 1, wherein the stop means is pivotably mounted upon the pivot means by which the gate structure is pivotably mounted on the supporting structure.

4. A gate according to claim 3, wherein the stop means comprises a stop plate pivotably mounted, between parts of the gate and supporting structure, on a pivot pin fixed in the said part of the latter.

5. A gate according to claim 4, wherein the stop plate has a stop projecting from one face for engagement by the said part of the gate structure and two stops projecting from the other face for engagement with the said part of the supporting structure, the stops being so disposed that the gate structure is arrested in each of its end positions by encounter of the said part of that structure with the first-named stop and encounter of a respective one of the said two stops with the said part of the supporting structure.

6. A gate according to claim 4, wherein the said parts are uprights of frames constituting the gate and supporting strucutures.

7. A gate according to claim 4, wherein the said parts of the gate and supporting structures are of box section and the said part of the gate structure is mounted on the pivot pin by means of a bearing bush extending through the said part of the gate structure.

* * * * *